US008744303B2

(12) United States Patent
Noguchi

(10) Patent No.: US 8,744,303 B2
(45) Date of Patent: Jun. 3, 2014

(54) DEVELOPING DEVICE

(71) Applicant: Canon Kabushiki Kaisha, Tokyo (JP)

(72) Inventor: Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 13/666,336

(22) Filed: Nov. 1, 2012

(65) Prior Publication Data

US 2013/0129376 A1 May 23, 2013

(30) Foreign Application Priority Data

Nov. 17, 2011 (JP) ..... 2011-251594

(51) Int. Cl.
*G03G 15/08* (2006.01)

(52) U.S. Cl.
CPC ..... *G03G 15/0817* (2013.01)
USPC ..... 399/103; 399/104

(58) Field of Classification Search
CPC ..... G03G 15/08; G03G 15/0806; G03G 15/0808; G03G 15/081; G03G 15/0812; G03G 15/0813; G03G 15/0817
USPC ..... 399/104, 103
See application file for complete search history.

(56) References Cited

U.S. PATENT DOCUMENTS

| | | | | | |
|---|---|---|---|---|---|
| 4,887,131 | A * | 12/1989 | Kinoshita et al. | ..... | 399/275 |
| 5,552,864 | A * | 9/1996 | Malicki et al. | ..... | 399/104 |
| 6,151,467 | A * | 11/2000 | Yamaguchi | ..... | 399/104 |
| 6,959,163 | B2 * | 10/2005 | Nishiyama | ..... | 399/269 |
| 2009/0285607 | A1 * | 11/2009 | Sakamaki et al. | ..... | 399/267 |
| 2011/0229189 | A1 * | 9/2011 | Okuno | ..... | 399/104 |
| 2013/0051842 | A1 * | 2/2013 | Nose | ..... | 399/104 |

FOREIGN PATENT DOCUMENTS

| | | | |
|---|---|---|---|
| JP | 10-213969 | A | 8/1998 |
| JP | 11-133750 | A | 5/1999 |
| JP | 2003-91157 | A | 3/2003 |
| JP | 2009-204783 | A | 9/2009 |

* cited by examiner

*Primary Examiner* — Clayton E Laballe
*Assistant Examiner* — Ruifeng Pu
(74) *Attorney, Agent, or Firm* — Canon USA Inc IP Division

(57) ABSTRACT

A magnetic flux density formed on a sleeve surface by a magnetic seal member on a downstream side in a conveyance direction of a developer agitation and conveyance member is greater than a magnetic flux density formed on the sleeve surface by a magnetic seal member on an upstream side in the developer conveyance direction.

7 Claims, 7 Drawing Sheets

DEVELOPING DEVICE

BACKGROUND OF THE INVENTION

1. Field of the Invention

The present disclosure relates to a developing device that develops an electrostatic latent image on a latent image bearing member with a developer including toner and a magnetic carrier. In particular, the present disclosure relates to a developing device that is used in an image forming apparatus such as a copying machine, a printer, a facsimile machine (FAX), and a multifunction peripheral having a plurality of such functions.

2. Description of the Related Art

An electrophotographic image forming apparatus includes a developing device for developing an electrostatic latent image formed on a charged photosensitive member. The developing device includes a developing sleeve, which is rotatably arranged in a position opposite the photosensitive member. The developing sleeve conveys a developer to a developing position opposite the photosensitive member, whereby the electrostatic latent image on the photosensitive member is developed.

The developer is stored in a developing container. Agitation screws agitate and circulate the developer in the developing container. Some of the developer may move in the axial direction of the developing sleeve to leak or scatter through the ends of the developing sleeve. A method for attaching elastic seal members to both ends of the developing sleeve in the developing container has conventionally been discussed to seal the ends so that the toner will not leak through the ends of the elastic seal members. For example, the elastic seal members may be pressed against the outer periphery of the developing sleeve for sealing. Pressing the elastic seal members against the outer periphery of the developing sleeve, however, causes a high load on the developing sleeve. Another problem is that the elastic seal members deteriorate and decrease in the sealability.

Some developing devices using toner or a carrier capable of magnetic attraction are configured to include magnetized magnetic seal members. The magnetic seal members are arranged on surfaces opposed at a predetermined distance to the surface of the developing sleeve, and magnetically attract and hold the developer for magnetic sealing (for example, see Japanese Patent Application Laid-Open No. 11-133750). Such a magnetic seal configuration has the advantage of reducing the rotation load of the developing sleeve since the developing sleeve and the magnetic seal members are not in contact with each other. The magnetic seal configuration also has the advantage of having long life due to the absence of abrasive deterioration.

According to the configuration of the developing device discussed in Japanese Patent Application Laid-Open No. 11-133750, the developer may leak from one of the ends of the developing sleeve after image formation on a large number of sheets. The problem is described below. As illustrated in FIG. 3, a developing device using a two-component developer is configured to circulate and convey the developer by agitation members 42 and 43 arranged in a developing chamber 41*a* and an agitation chamber 41*b*. The first agitation member 42 conveys the developer stored in the developing chamber 41*a* in the direction of the arrow. In the developing chamber 41*a*, the developer, therefore, flows more into the end portion of the developing sleeve 44 on the downstream side 41*e* in the conveyance direction of the developer and the pressure of the developer becomes higher than on the upstream side 41*d* in the conveyance direction of the developer. Such a phenomenon is found to appear as the leakage of the developer on the downstream side 41*e* in the conveyance direction of the developer after image formation on a large number of sheets.

To increase the sealability so that the developer conveyed by the first agitation member 42 arranged in the developing chamber 41*a* will not leak from the downstream side 41*e* in the conveyance direction of the developer, the magnetic seal members may be configured to have a higher magnetic force. However, increasing the magnetic force of the magnetic seal members can in turn cause a toner leakage on the upstream side 41*d* in the conveyance direction of the developer. A possible mechanism of the toner leakage is described below. In areas where the magnetic seal members strongly bind the developer, some of the developer forms an immobile layer. The boundary between the immobile layer portion and a fluid portion of the developer moved by the developing sleeve 44 tends to cause friction and fixing of the toner, whereby the toner coagulates easily. The coagulated toner is considered to leave from the carrier and eventually cause a toner leakage. The toner leakage is found to be particularly likely to occur on the upstream side 41*d* in the conveyance direction of the developer. The reason is that in the developing chamber 41*a*, the developer flows less into the end portion of the developing sleeve 44 on the upstream side 41*d* in the conveyance direction of the developer and thus a smaller amount of developer is replaced than on the downstream side 41*e* in the conveyance direction of the developer. Of the magnetic seal portions at both ends, the toner is considered to be more likely to coagulate in the magnetic seal portion on the upstream side 41*d* in the conveyance direction of the developer than on the downstream side 41*e* in the conveyance direction of the developer.

A developing device of the vertical agitation type, including a developing chamber and an agitation chamber arranged one above the other, has a similar problem. With the vertical agitation developing device, the developer convey-up side of the developer circulation path is more susceptible to the developer pressure than the convey-down side. The developer is more likely to leak from the developer convey-up side. The magnetic flux densities of the magnetic seal members at both ends of the developing sleeve may be increased to suppress the leakage of the developer, in which case the toner can coagulate to cause a toner leakage.

SUMMARY OF THE INVENTION

The present disclosure is directed to a configuration that magnetically seals both ends of a developer bearing member, wherein the configuration suppresses the leakage of a developer from the ends of the developer bearing member and suppresses the coagulation of toner in the seal portions and the leakage of the toner from the ends of the developer bearing member.

According to an aspect disclosed herein, a developing device includes a developer bearing member configured to bear a developer including toner and a magnetic carrier and to develop an electrostatic image formed on an image bearing member, a developing container including a developing chamber and an agitation chamber, the developing chamber being configured to store the developer to be supplied to the developer bearing member in a position where the developing chamber faces the developer bearing member and to collect the developer supplied to the developer bearing member in the position where the developing chamber faces the developer bearing member, the agitation chamber being configured to communicate with the developing chamber at both ends thereof to form a circulation path to agitate the developer, a conveyance member arranged in the developing chamber and configured to convey the developer, a first magnet member arranged in the developing container on a side of one end of the developer bearing member on a downstream side in a developer conveyance direction of the developing chamber, opposite the developer bearing member along a circumferential direction of the developer bearing member, and configured to magnetically seal the one end of the developer bearing member, and a second magnet member arranged in the developing container on a side of the other end of the developer bearing member on an upstream side in the developer conveyance direction of the developing chamber, opposite the developer bearing member along the circumferential direction of the developer bearing member, and configured to magnetically seal the other end of the developer bearing member such that a magnetic flux density formed by the second magnet member on a surface of the developer bearing member is less than a magnetic flux density formed by the first magnet member.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the disclosure will be described in detail below with reference to the drawings.

Figure 1:
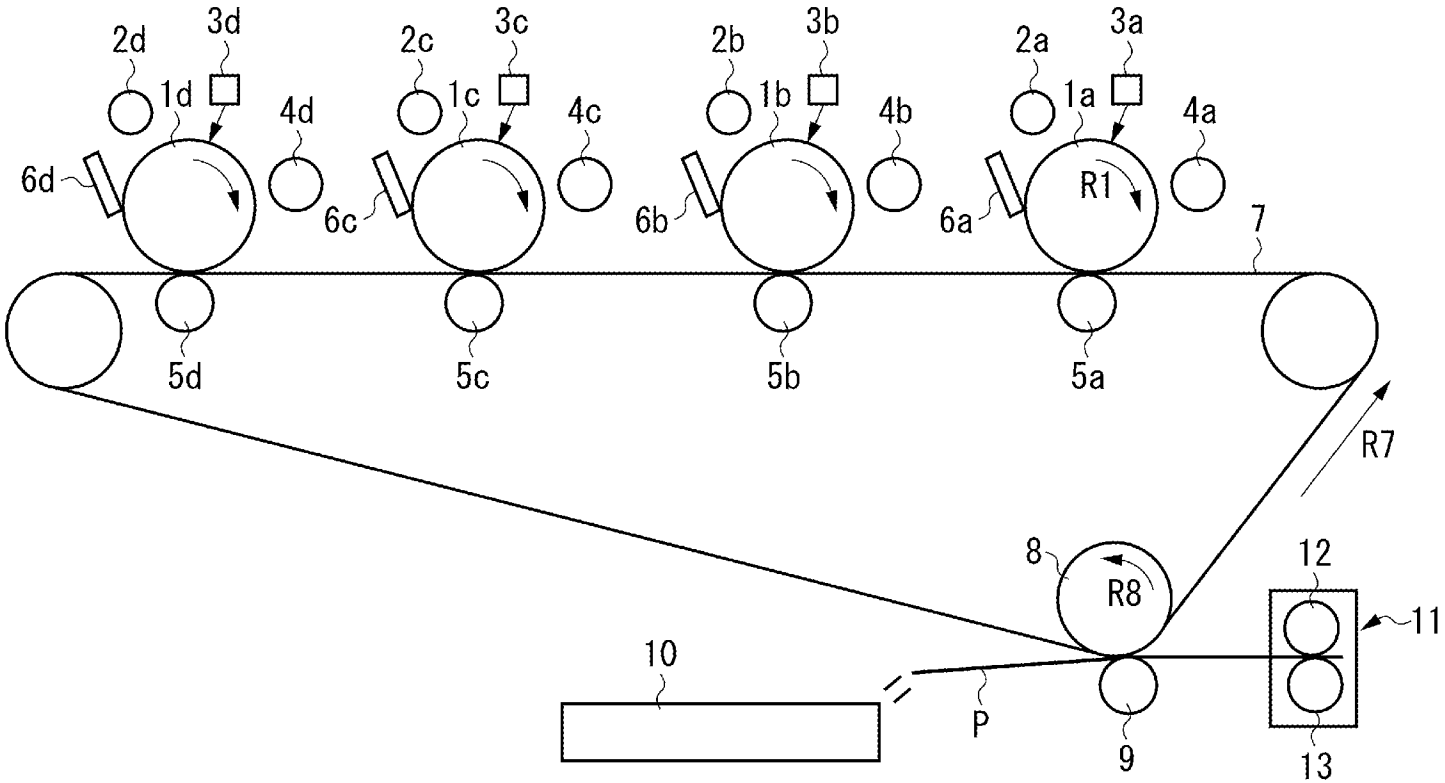
FIG. 1 is a diagram illustrating an image forming apparatus according to a first exemplary embodiment.

FIG. 1 illustrates an image forming apparatus according to a first exemplary embodiment of the present disclosure. The image forming apparatus is a four-color full color electrophotographic image forming apparatus including four image forming units. FIG. 1 is a longitudinal sectional view schematically illustrating a general configuration of the image forming apparatus.

The image forming apparatus illustrated in FIG. 1 includes the four image forming units (image forming stations) which are arranged from an upstream side to a downstream side along the rotational direction (the direction of the arrow R7) of an intermediate transfer belt 7 serving as an intermediate transfer member. The image forming units include drum-shaped electrophotographic photosensitive members (hereinafter, referred to as "photosensitive drums") 1*a*, 1*b*, 1*c*, and 1*d* as their respective image bearing members. The photosensitive drums 1*a*, 1*b*, 1*c*, and 1*d* form toner images in yellow, magenta, cyan, and black, respectively. The photosensitive drums 1*a*, 1*b*, 1*c*, and 1*d* are driven to rotate in the directions of the respective arrows R1 (clockwise in FIG. 1). Charging devices (charging units) 2*a*, 2*b*, 2*c*, and 2*d*, exposure devices (latent image forming units) 3*a*, 3*b*, 3*c*, and 3*d*, and developing devices (developing units) 4*a*, 4*b*, 4*c*, and 4*d* are arranged around the respective photosensitive drums 1*a*, 1*b*, 1*c*, and 1*d* generally in this order along the direction of rotation. Primary transfer rollers (primary transfer units) 5*a*, 5*b*, 5*c*, and 5*d*, and drum cleaners (cleaning devices) 6*a*, 6*b*, 6*c*, and 6*d* are further arranged.

The endless intermediate transfer belt 7 serving as an intermediate transfer member is laid across the primary transfer rollers 5*a*, 5*b*, 5*c*, and 5*d*, and a secondary transfer counter roller 8. The intermediate transfer belt 7 is pressed by the primary transfer rollers 5*a*, 5*b*, 5*c*, and 5*d* from the back side with its surface in contact with the photosensitive drums 1*a*, 1*b*, 1*c*, and 1*d*. The intermediate belt 7 is configured to rotate in the direction of the arrow R7 as the secondary transfer counter roller 8, which also serves as a driving roller, rotates in the direction of the arrow R8. The rotation speed of the intermediate transfer belt 7 is set to be almost the same as the rotation speed (process speed) of the photosensitive drums 1*a*, 1*b*, 1*c*, and 1*d*.

A secondary transfer roller (secondary transfer unit) 9 is arranged in a position corresponding to the secondary transfer counter roller 8 on the surface of the intermediate transfer belt 7. The secondary transfer roller 9 and the secondary transfer counter roller 8 hold the intermediate transfer belt 7 therebetween in such a manner that a secondary transfer nip (secondary transfer portion) is formed between the secondary transfer roller 9 and the intermediate transfer belt 7. A transfer material P intended for image formation is stacked and stored in a sheet feeding cassette 10. A feeding and conveyance device including a sheet feeding roller, a conveyance roller, and a registration roller (none of which is illustrated) supplies the transfer material P to the secondary transfer nip portion. A fixing device 11 including a fixing roller 12 and a pressure roller 13 pressed against the fixing roller 12 is arranged on the downstream side of the secondary transfer nip in the conveyance direction of the transfer material P. A discharge tray is further arranged on the downstream side of the fixing device 11.

In the image forming apparatus having such a configuration, a four-color full color toner image is formed on the transfer material P in the following manner. Photosensitive drum driving motors (not illustrated) initially drive the photosensitive drums 1*a*, 1*b*, 1*c*, and 1*d* to rotate in the directions of the arrows R1 at a predetermined process speed. The charging devices 2*a*, 2*b*, 2*c*, and 2*d* uniformly charge the photosensitive drums 1*a*, 1*b*, 1*c*, and 1*d* with a predetermined polarity and potential. The exposure devices 3*a*, 3*b*, 3*c*, and 3*d* perform exposure on the charged photosensitive drums 1*a*, 1*b*, 1*c*, and 1*d* based on image information. Electric charges at the exposed portions are removed to form electrostatic latent images (electrostatic images) of the respective colors. The developing devices 4*a*, 4*b*, 4*c*, and 4*d* develop the electrostatic latent images on the photosensitive drums 1*a*, 1*b*, 1*c*, and 1*d* into toner images in yellow, magenta, cyan, and black, respectively. The primary transfer rollers 5*a*, 5*b*, 5*c*, and 5*d* primarily transfer the toner images in the four colors onto the intermediate transfer belt 7 in their primary transfer nips in succession. The toner images in the four colors are thereby superposed on each other on the intermediate transfer belt 7.

The toners not transferred to the intermediate transfer belt 7 by the primary transfer and left on the photosensitive drums 1*a*, 1*b*, 1*c*, and 1*d* (residual toners) are removed by the drum cleaners 6*a*, 6*b*, 6*c*, and 6*d*. The photosensitive drums 1*a*, 1*b*, 1*c*, and 1*d*, from which the residual toners have been removed, are subjected to the next image formation. The toner images in the four colors, superposed on the intermediate transfer belt 7 as described above, are secondarily transferred to the transfer material P. The feeding and conveyance device conveys the transfer material P from the sheet feeding cassette 10, and the registration roller supplies the transfer material P to the secondary transfer nip in synchronization with the toner image on the intermediate transfer belt 7. In the secondary transfer nip, the secondary transfer roller 9 secondarily transfers the toner images in the four colors on the intermediate transfer belt 7 to the supplied transfer material P by a single operation. The transfer material P to which the toner images in the four colors are secondarily transferred is conveyed to the fixing device 11. The fixing device 11 applies heat and pressure to the transfer material P to fix the toner images to the surface thereof. The transfer material P to which the toner images are fixed is discharged onto the discharge tray. Four-color full color image formation on one side (surface) of a sheet of transfer material P has thus been completed.

Figure 2:
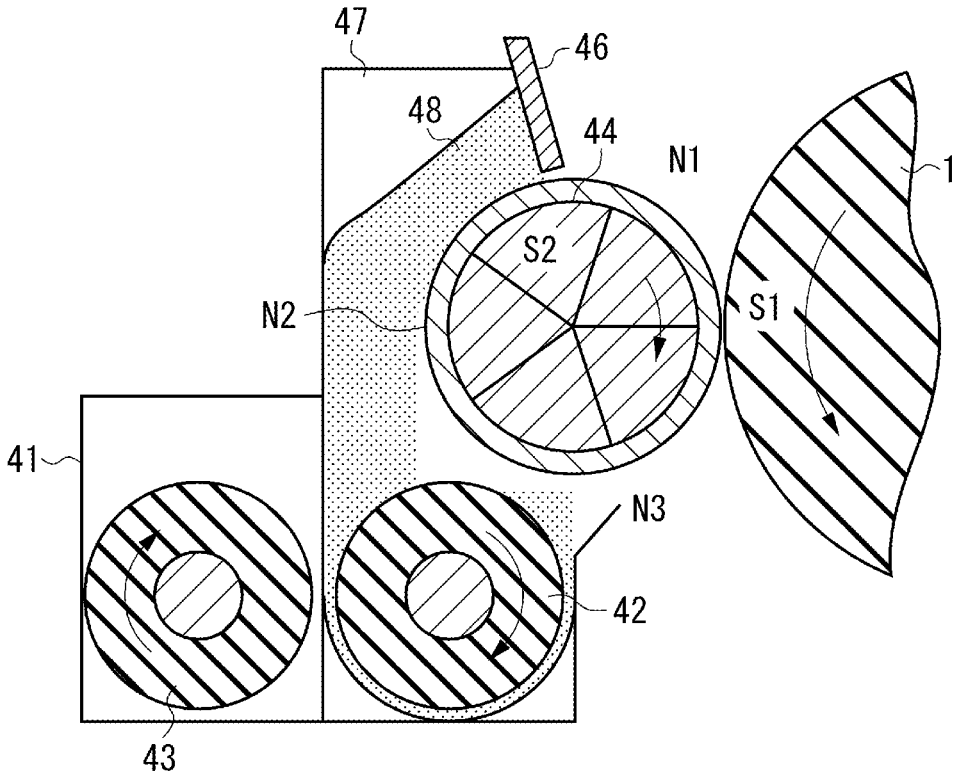
FIG. 2 is a sectional view illustrating a developing device according to an exemplary embodiment and a conventional developing device.
Figure 3:
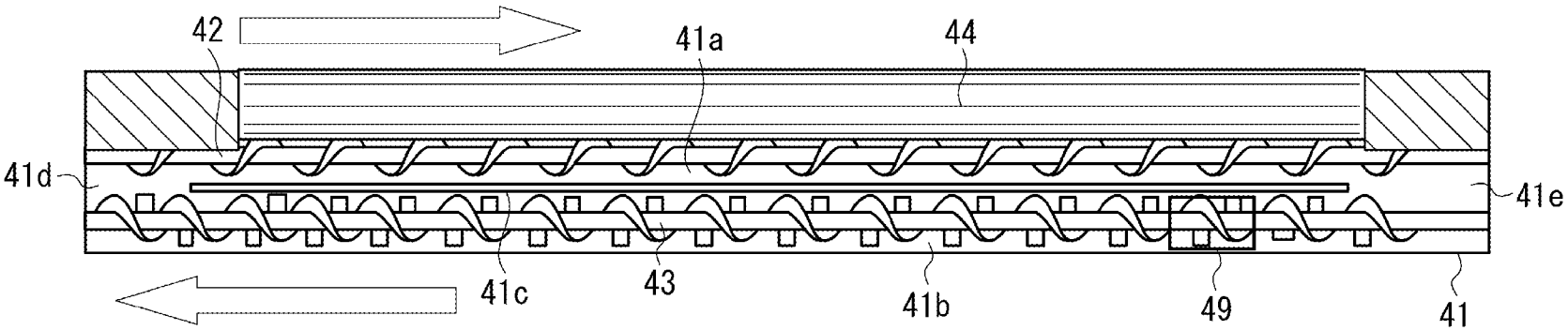
FIG. 3 is another sectional view illustrating the developing device according to the exemplary embodiment and the conventional developing device.

The developing devices 4*a*, 4*b*, 4*c*, and 4*d* according to the present exemplary embodiment will be described in detail with reference to FIGS. 2 and 3. Since the developing devices 4*a*, 4*b*, 4*c*, and 4*d* used in the main body of the image forming apparatus according to the present exemplary embodiment have the same configuration, only one of the developing devices 4*a*, 4*b*, 4*c*, and 4*d* will be described. In the following description, a developing device 4 may refer to any one of the developing devices 4*a*, 4*b*, 4*c*, and 4*d*. FIGS. 2 and 3 are sectional views of the developing device 4 according to the present exemplary embodiment.

The developing device 4 according to the present exemplary embodiment includes a developing container 41. The developing container 41 stores a two-component developer including toner and a carrier as a developer. The developing container 41 includes a developing sleeve 44, which serves as a developer bearing member, and a regulation blade 46, which regulates brushes of the developer borne by the developing sleeve 44.

In the present exemplary embodiment, the developing container 41 includes a partition wall 41*c* which extends in the direction perpendicular to the plane of FIG. 2. The partition wall 41*c* horizontally sections the general central part of the interior of the developing container 41 into a developing chamber 41*a* and an agitation chamber 41*b* to form a circulation path. The developer is stored in the developing chamber 41*a* and the agitation chamber 41*b*. The developing chamber 41*a* and the agitation chamber 41*b* include first and second conveyance screws 42 and 43, respectively, as a developer agitation and conveyance unit.

The first conveyance screw 42 is arranged at the bottom of the developing chamber 41*a* along and almost in parallel with the axial direction of the developing sleeve 44. The first conveyance screw 42 rotates in the direction of the arrow illustrated in FIG. 2 (clockwise) to axially convey the developer in the developing chamber 41*a* in one direction. The reason for the clockwise rotation is that such a rotation is advantageous in terms of the supply of the developer to the developing sleeve 44.

The second conveyance screw 43 is arranged at the bottom of the agitation chamber 41*b* almost in parallel with the first conveyance screw 42. The second conveyance screw 43 rotates to convey the developer in the agitation chamber 41*b* in the direction opposite that of the first conveyance screw 42.

As illustrated in FIG. 3, the first and second conveyance screws 42 and 43 rotate to convey the developer in such a manner that the developer circulates through the developing chamber 41*a* and the agitation chamber 41*b* via openings (communication portions) 41*d* and 41*e* at both ends of the partition wall 41*c*. A toner replenishment port 49 for replenishing the toner is formed in a part of the agitation chamber 41*b*. The toner replenishment port 49 is typically arranged in the agitation chamber 41*b*. The reason is that the toner and the carrier can be agitated to stabilize the amount of charge on the toner as much as possible before the developer is supplied from the developing chamber 41*a* to the developing sleeve 44.

In the present exemplary embodiment, the developing container 41 has an opening. The developing sleeve 44 is rotatably arranged in the opening in such a manner that the developing sleeve 44 is partly exposed in the direction of the photosensitive drum 1. The developing sleeve 44 bears and conveys the developer to a developing area opposite the photosensitive drum 1.

The developing sleeve 44 is 20 mm in diameter. The photosensitive drum 1 is 80 mm in diameter. The distance between the developing sleeve 44 and the photosensitive drum 1 in the nearest area is approximately 300 μm. Such settings enable development in such a state that the developer conveyed to the developing area is in contact with the photosensitive drum 1. The developing sleeve 44 is made of a nonmagnetic material such as aluminum and stainless steel. A magnet roller 45, which is a magnetic field unit, is non-rotatably arranged inside the developing sleeve 44. The magnet roller 45 includes a developing pole 51, which is opposite the photosensitive drum 1 in the developing area. The magnet roller 45 further includes a magnetic pole S2, which is opposite the regulation blade 46, and a magnetic pole N1, which is arranged between the developing pole S1 and the magnetic pole S2. The magnet roller 45 also includes a magnetic pole N2, which is arranged on the upstream side of the magnetic pole S2 in the rotational direction of the developing sleeve 44, and a magnetic pole N3, which is arranged on the downstream side of the magnetic pole S1 in the rotational direction of the developing sleeve 44.

Figure 4A:
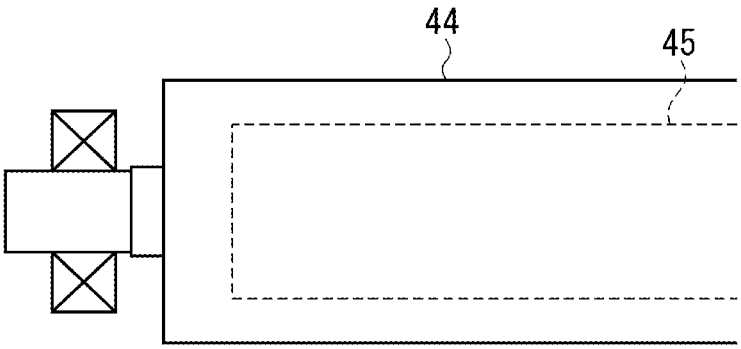
FIGS. 4A and 4B are schematic diagrams illustrating an end of a developing sleeve according to the first exemplary embodiment.
Figure 4B:
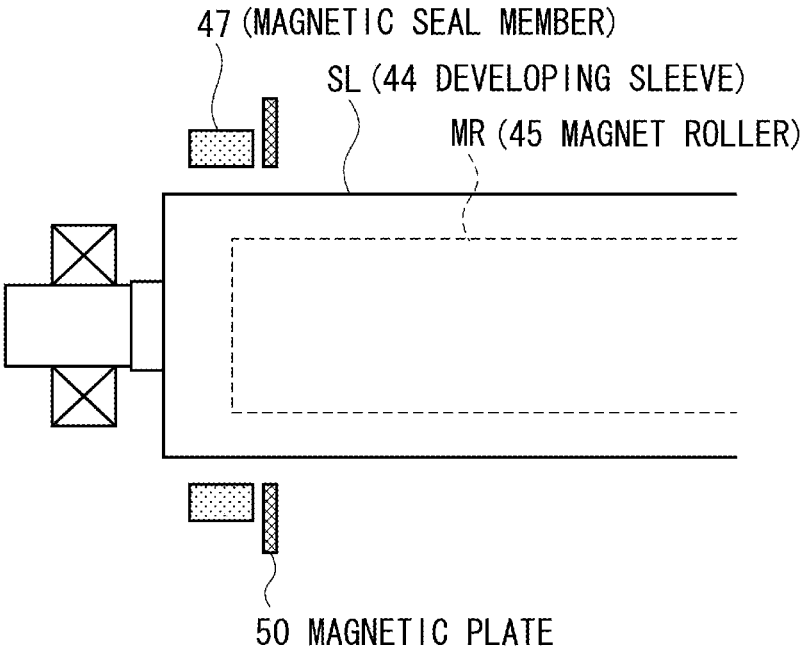
Figure 5:
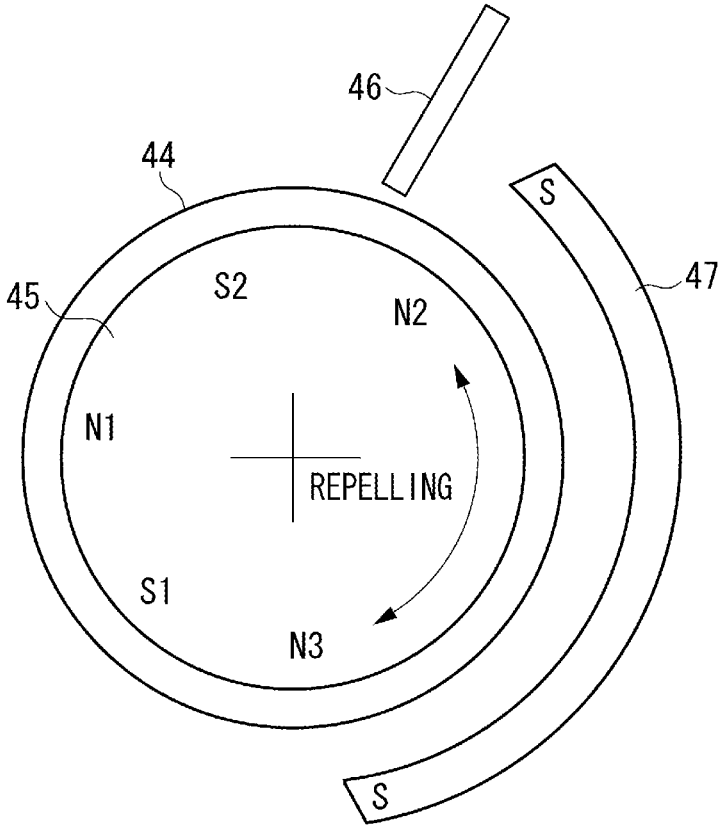
FIG. 5 is a diagram illustrating a positional relationship between the developing sleeve and a magnetic seal member at an end of the developing sleeve.

Magnetic seal portions at ends of the developing sleeve 44, which are characteristic portions of the present exemplary embodiment, will be described in detail with reference to FIGS. 4A, 4B, and 5. In the present exemplary embodiment, magnetic plates 50 are arranged opposite the developing sleeve 44 at both ends of the developing sleeve 44. The magnetic plates 50 are arranged along the circumferential direction of the developing sleeve 44. The ends of the developing sleeve 44 are thereby magnetically sealed to prevent the leakage of the developer. The magnetic plates 50 are also opposite the magnet roller 45 inside the developing sleeve 44. The magnet roller 45 produces a magnetic force that magnetizes the magnetic plates 50 to form magnetic brushes between the developing sleeve 44 and the magnetic plates 50 for the sake of a magnetic sealing effect.

Note that the magnet roller 45 produces little magnetic force between its repelling poles, namely, the adjoining magnetic poles N2 and N3 of the same polarity. The magnetic plates 50 are, therefore, little magnetized and fail to provide a sealability between the repelling poles.

Magnet members are arranged longitudinally outside the magnetic plates 50. The magnet members are closely arranged along the developing sleeve 44 in a non-contact state at a distance of approximately 1 mm. In the present exemplary embodiment, plate-shaped magnets (magnet plates) 47 are arranged as magnetic seal members. Such a configuration can form magnetic brushes of the developer between the magnet roller 45 inside the developing sleeve 44 and the magnets 47 serving as the magnetic seal members, whereby the developer coming though between the magnetic plates 50 and the developing sleeve 44 can be prevented from leaking out.

In the present exemplary embodiment, magnet plates having the N pole on one side and the S pole on the backside are used as the magnetic seal members 47. The magnetic seal member 47 can be placed so that their surface having the polarity opposite that of the poles (N2 and N3) forming the repelling magnetic field of the magnet roller 45 inside the developing sleeve 44 faces the developing sleeve 44. In such a case, the magnetic lines of force extending between the magnet roller 45 in the developing sleeve 44 and the magnetic seal members 47, the magnets, can form magnetic brushes of the developer to prevent leakage. The magnetic seal member 47 are not limited to such a configuration. The magnetic seal members 47 may be arranged with the surfaces of the same polarity toward the developing sleeve 44 as long as magnetic brushes can be formed between the developing sleeve 44 and the magnetic seal members 47.

Now, the problem to be solved by the present invention will be described again before the description of the configuration of an exemplary embodiment. As has been described in the "Description of the Related Art" section, after a long period of use of the developing device 4, the configuration to magnetically seal both ends of the developing sleeve 44 can cause the following problem. If the magnetic seal members 47 form only a low magnetic flux density on the surface of the developing sleeve 44, the sealability is low and the developer leaks. On the other hand, if the magnetic seal members 47 form a high magnetic flux density on the surface of the developing sleeve 44, the sealability is high and the developer bound by the magnetic seal members 47 forms an immobile layer. The toner coagulates on the boundary between the immobile layer portion and the fluid layer portion, causing a toner leakage. The toner coagulation can also adhere to an image to cause an image defect.

Studies were made and it was found that sealing under an identical condition might fail to sufficiently seal the developer and might cause the leakage of the developer on the downstream side in the developer conveyance direction. More specifically, the upstream side and downstream side in the conveyance direction of the first conveyance screw 42 arranged in the developing chamber 41*a* correspond to the front and rear positions in terms of the moving direction of the developer. Different pressures, therefore, act on the respective ends of the developing sleeve 44. The amounts of the developer to flow into the magnetic seal members 47 arranged on the ends of the developing sleeve 44 are different, which facilitates the leakage of the developer.

To prevent the leakage of the developer, the magnetic flux densities of the magnetic seal member 47 at both ends may be uniformly increased under the same condition. In such a case, the toner has been found to tend to leak and cause toner coagulation on an image on the upstream side in the developer conveyance direction.

The developer bound by the magnetic seal members 47 at the ends of the developing sleeve 44 is partly conveyed by the developing sleeve 44 and separated into a fluid layer and an immobile layer, whose shear plane can produce toner coagulation. Some of the developer bound by the magnetic seal member 47 is replaced because of the rotation of the developing sleeve 44 and the developer conveyance force of the first conveyance screw 42. The more the developer flows in, the faster the replacement is and the less likely an immobile layer is to occur. Toner coagulation has thus been found to be more likely to occur on the upstream side than on the downstream side in the developer conveyance direction.

The following experiment was made to examine the magnetic sealability. Initially, the magnetic seal members 47 at the ends of the developing sleeve 44 were arranged along the developing sleeve 44 in a non-contact state at a distance of approximately 1 mm. The magnetic flux density of the magnetic seal member 47 on the upstream side in the conveyance direction of the first conveyance screw 42 arranged in the developing chamber 41*a* and that of the magnetic seal member 47 on the downstream side in the conveyance direction were changed to prepare a plurality of developing devices 4. The developing devices 4 were examined and compared for the leakage of the developer, the occurrence of coagulation, and the leakage of the toner.

Specifically, the ratio by weight of the toner to the developer (T/D) was set to 8%. With the image ratio and other conditions being equal, image formation was repeated on 1000000 sheets of A4 paper before the developing devices 4 were examined and compared for the leakage of the developer, the occurrence of coagulation, and the leakage of the toner. Table 1 shows the evaluation results.

TABLE 1

| Magnetic | Upstream Side in Developer Conveyance Direction | | Downstream Side in Developer Conveyance Direction | |
|---|---|---|---|---|
| Flux Density of Magnetic Seal Member | Leakage of Toner/Occurrence of Coagulation | Leakage of Developer | Leakage of Toner/Occurrence of Coagulation | Leakage of Developer |
| 20 mT | OK | OK | OK | NG |
| 25 mT | OK | OK | OK | NG |
| 30 mT | OK | OK | OK | NG |
| 35 mT | OK | OK | OK | NG |
| 40 mT | NG | OK | OK | OK |
| 45 mT | NG | OK | OK | OK |
| 50 mT | NG | OK | OK | OK |

As can be seen from Table 1, if the magnetic seal member 47 on the upstream side in the conveyance direction of the first conveyance screw 42 was set to a magnetic flux density of 40 mT (millitesla) or more, the occurrence of toner coagulation and the leakage of the toner were observed because of too high a binding force on the developer. On the other hand, if the magnetic seal member 47 on the downstream side in the conveyance direction of the first conveyance screw 42 was set to 35 mT or less, the leakage of the developer was found to occur due to insufficient sealing of the developer.

Then, in the present exemplary embodiment, the distances between the developing sleeve 44 and the magnetic seal members 47 were set to 1 mm at both ends of the developing sleeves. The magnetic seal members 47 were configured to have different magnetic forces on the one and the other sides of the developing sleeve 44. Specifically, a magnetic seal member 47 (first magnet member) was arranged on the upstream side in the conveyance direction of the first conveyance screw 42. The first magnet member was configured to form a magnetic flux density of 30 mT on the surface of the developing sleeve 44. A magnetic seal member 47 (second magnet member) was arranged on the downstream side in the conveyance direction of the first conveyance screw 42. The second magnet member was configured to form a magnetic flux density of 50 mT on the surface of the developing sleeve 44. Such a configuration successfully prevented the leakage of the developer, the occurrence of toner coagulation, and the leakage of the toner.

Examples of the magnetic seal members 47 include rubber magnets (magnets made by kneading rubber with magnetic powder) and neodymium-based magnets magnetized to a magnetic flux density of 5 to 100 mT. Magnetic flux densities of 5 mT or less make the formation of magnetic brushes difficult and provide only a poor magnetic sealability. Rubber magnets having appropriate elasticity can be pasted to the shape of the developing sleeve 44. In the present exemplary embodiment, the distances between the developing sleeve 44 and the magnetic seal members 47 were set to 1 mm as described above.

As has been described above, the magnetic flux density formed on the sleeve surface by the magnetic seal member 47 on the downstream side in the conveyance direction of the conveyance screw 42 arranged in the developing chamber 41*a* is made greater than the magnetic flux density formed on the sleeve surface by the magnetic seal member 47 on the upstream side in the developer conveyance direction. Such a configuration can provide a developing device 4 that prevents the leakage of the developer and causes no toner coagulation and toner leakage.

An image forming apparatus according to a second exemplary embodiment of the present disclosure has a basic configuration similar to that of the first exemplary embodiment. A description of the entire image forming apparatus will thus be omitted, and differences are described below. In the first exemplary embodiment, the magnetic flux densities of the magnetic seal members 47 are modified to provide different magnetic sealing capabilities at respective ends. The second exemplary embodiment is different in that the distances between the developing sleeve 44 and the magnetic seal members 47 are modified to provide different magnetic sealing capabilities.

The sealability at the ends of the developing sleeve 47 depends not only on the magnetic flux densities of the magnetic seal members 47 but also on the distances between the developing sleeve 44 and the magnetic seal members 47. The smaller the distances between the developing sleeve 44 and the magnetic seal members 47, the greater the magnetic binding force near the surface of the developing sleeve 44 and the more improved the sealability of the developer bound by the magnetic seal members 47. If the magnetic binding force is too large, toner coagulation tends to occur like when the magnetic flux densities of the magnetic seal members 47 are increased.

In the second exemplary embodiment, the magnetic seal members 47 arranged on both ends of the developing sleeve 44 are configured to have a magnetic flux density of 40 mT each. Then, the distance between the developing sleeve 44 and the magnetic seal member 47 on the upstream side in the conveyance direction of the first conveyance screw 42 arranged in the developing chamber 41*a* is made smaller than the distance between the developing sleeve 44 and the magnetic seal member 47 on the downstream side in the conveyance direction.

With the magnetic seal members 47 at both ends given the same magnetic flux density, only the distances between the developing sleeve 44 and the magnetic seal members 47 were changed to prepare a plurality of developing devices 4. Table 2 shows the experimental results as to the leakage of the developer, the occurrence of coagulation, and the leakage of the toner. The ratio by weight of the toner to the developer (T/D) was set to 8%. With the image ratio and other conditions being equal, image formation was repeated on 1000000 sheets of A4 paper before the developing devices 4 were compared.

TABLE 2

| Distance between Developing Sleeve and Magnetic Seal Member | Upstream Side in Developer Conveyance Direction | | Downstream Side in Developer Conveyance Direction | |
|---|---|---|---|---|
| | Leakage of Toner | Leakage of Developer | Leakage of Toner | Leakage of Developer |
| 0.6 mm | NG | OK | OK | OK |
| 0.7 mm | NG | OK | OK | OK |
| 0.8 mm | NG | OK | OK | OK |
| 0.9 mm | NG | OK | OK | OK |
| 1.0 mm | NG | OK | OK | OK |
| 1.1 mm | OK | OK | OK | NG |
| 1.2 mm | OK | OK | OK | NG |

As can be seen from Table 2, the occurrence of toner coagulation and the leakage of the toner were observed on the upstream side in the conveyance direction of the first conveyance screw 42 because of too high a binding force on the developer if the distance between the developing sleeve 44 and the magnetic seal member 47 was set to 1 mm or less. On the downstream side in the conveyance direction of the first conveyance screw 42, the leakage of the developer was found to occur because of insufficient sealing of the developer if the distance between the developing sleeve 44 and the magnetic seal member 47 was set to 1.1 mm or more.

The distance between the developing sleeve 44 and the magnetic seal member 47 on the upstream side in the conveyance direction of the first conveyance screw 42 was then set to 1.2 mm. The distance between the developing sleeve 44 and the magnetic seal member 47 on the downstream side in the conveyance direction was set to 0.8 mm. Such a configuration successfully prevented the leakage of the developer, the occurrence of toner coagulation, and the leakage of the toner.

The distances are not limited to the foregoing, and can range as far as at least the magnetic brushes formed on the magnet plates make contact with the outer periphery of the developing sleeve 44 for sealing. Distances in the range of 0.3 to 2.0 mm can be selected in consideration of the magnetic flux densities. More specifically, appropriate distances can be set within the foregoing range according to the amount of magnetization of the magnetic carrier used in the developer, the rotation speed of the first conveyance screw 42, the shape of the developing device 4, and the positional relationship between the developing sleeve 44 and the first conveyance screw 42.

As has been described above, the magnetic flux density formed on the sleeve surface by the magnetic seal member 47 on the downstream side in the conveyance direction of the conveyance screw 42 arranged in the developing chamber 41*a* is made greater than the magnetic flux density formed on the sleeve surface by the magnetic seal member 47 on the upstream side in the developer conveyance direction. Such a configuration can provide a developing device 4 that prevents the leakage of the developer and causes no toner coagulation or toner leakage.

The second exemplary embodiment has dealt with the example where the magnetic flux densities of the magnetic seal members 47 on both ends are the same. However, the configuration is not limited thereto. For example, the first exemplary embodiment and the second exemplary embodiment may be used in combination. The magnetic flux density formed on the sleeve surface by the magnetic seal member 47 on the downstream side in the conveyance direction of the conveyance screw 42 arranged in the developing chamber 41*a* has only to be greater than the magnetic flux density formed on the sleeve surface by the magnetic seal member 47 on the upstream side in the developer conveyance direction. It will also be understood that the material of the photosensitive drums 1 used in the image forming apparatus according to the second exemplary embodiment, the developer, and the configuration of the image forming apparatus are not limited to the foregoing. An exemplary embodiment of the present invention is applicable to various types of developers and image forming apparatuses. Specifically, the colors and the number of colors of the toners, the presence or absence of wax, the order of development of the color toners, and the number of developer agitation and conveyance members are not limited to the present exemplary embodiment. An exemplary embodiment of the present invention is applicable to developing devices of other forms.

An image forming apparatus according to a third exemplary embodiment of the present disclosure has a basic configuration similar to that of the first exemplary embodiment. A description of the entire image forming apparatus will thus be omitted. The third exemplary embodiment deals with a function-separated vertical agitation developing device, which includes developer agitation and conveyance members arranged one above the other. One of the characteristics of the function-separated vertical agitation developing device is that the lateral width can be reduced for miniaturization. Since the position where the developer is supplied to the developing sleeve 44 is different from the position where the developer is collected from the developing sleeve 44, the developer whose toner density has been reduced through the process of developing the toner over the photosensitive member 1 can be sufficiently agitated before being supplied to the developing sleeve 44 again. Such a configuration is effective against problems such as a reduced density and a longitudinally uneven density.

Figure 6:
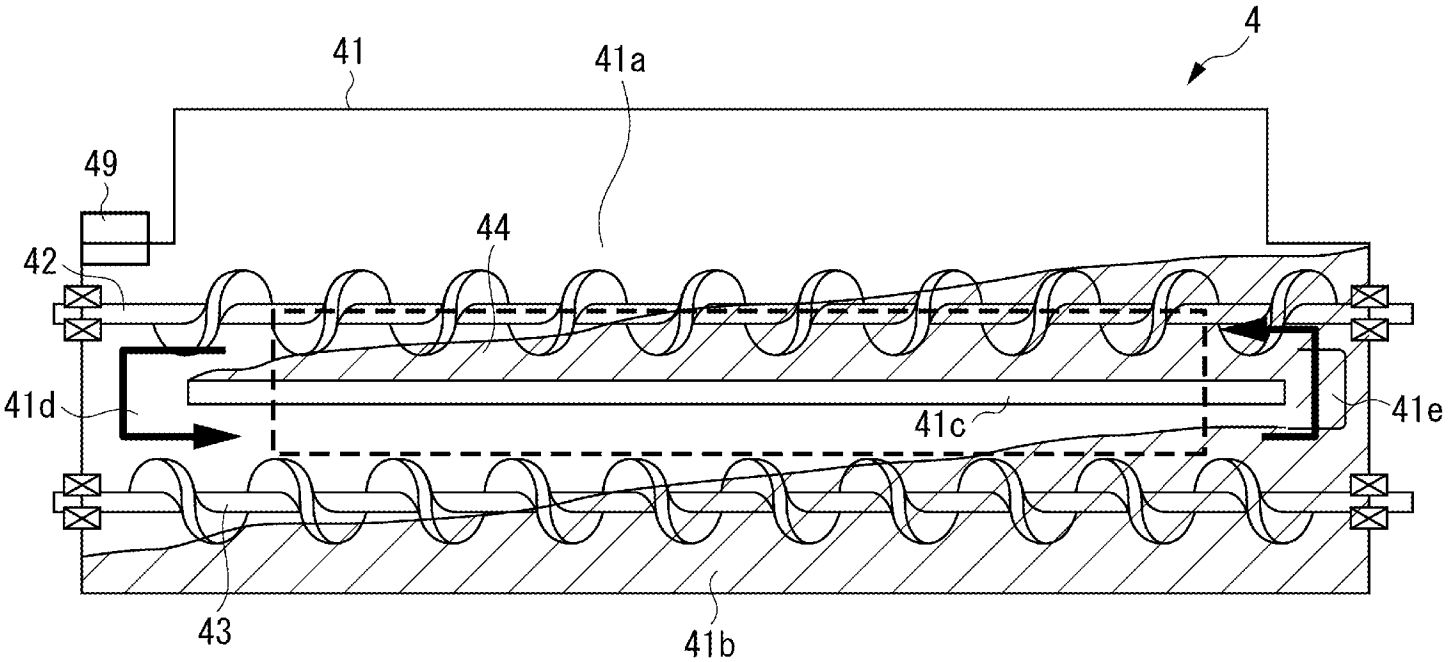
FIG. 6 is a sectional view illustrating a developing device according to a third exemplary embodiment.
Figure 7:
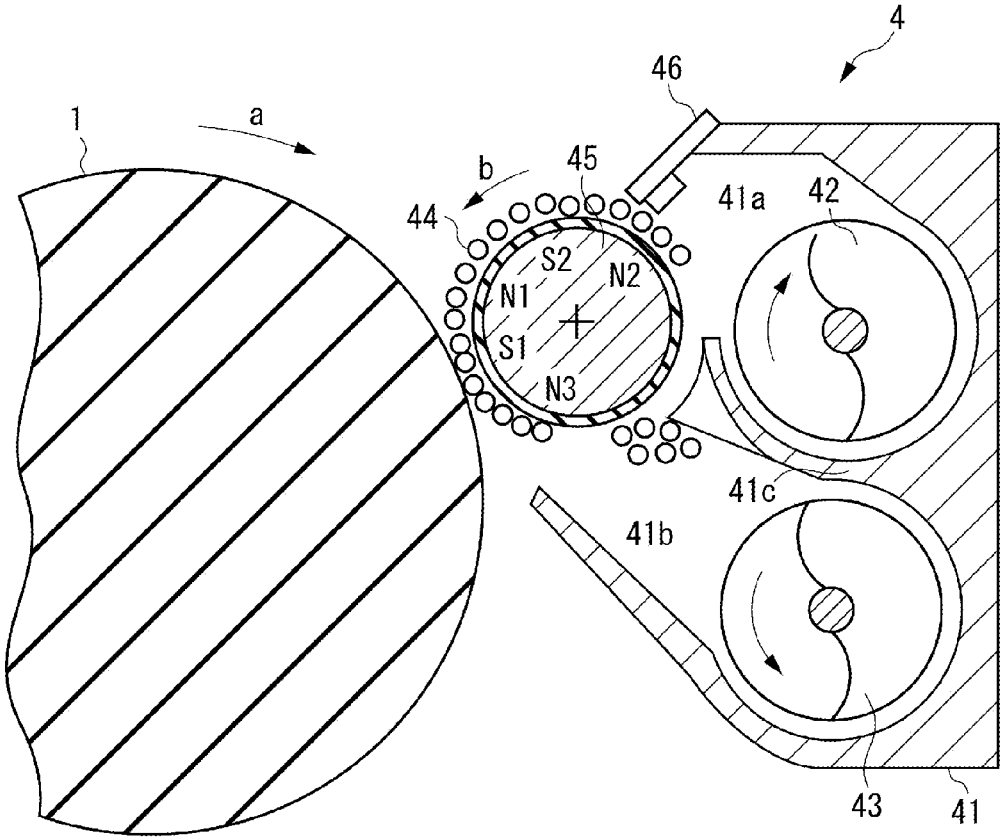
FIG. 7 is a sectional view illustrating the developing device according to the third exemplary embodiment.

The developing device 4 according to the third exemplary embodiment will be described with reference to FIGS. 6 and 7. In the third exemplary embodiment, a partition wall 41*c* vertically sections the interior of the developing container 41 into a developing chamber 41*a* and an agitation chamber 41*b*.

In the developing device 4 of the third exemplary embodiment, the developer is conveyed to circulate through the developing chamber 41*a* and the agitation chamber 41*b* via openings (communication portions) 41*d* and 41*e* at both ends of the partition wall 41*c*. The developer is supplied from the developing chamber 41*a* to the developing sleeve 44, and the developer conveyed by the developing sleeve 44 is taken into the agitation chamber 41*b*. The agitation chamber 41*b* is arranged in a position different from that of the developing chamber 41*a* in the direction of gravity. As illustrated in FIG. 6, the amount of the developer lying in the agitation chamber 41*b* increases as the developer approaches the opening 41*e* in the convey-up portion where the developer is conveyed upward in the direction of gravity. Since the developer past the developing sleeve 44 joins the developer conveyed from the opening 41*d* by the second conveyance screw 43, the amount of the developer increases to the downstream side in the developer conveyance direction of the second conveyance screw 43.

Studies were made and the following was found. Different pressures act on the ends of the developing sleeve 44 on the upstream side and the downstream side in the conveyance direction of the second conveyance screw 43 arranged in the agitation chamber 41*b*. More specifically, the convey-down side of the developing device 4 where the developer falls through the opening 41*d* and the convey-up side where the developer is lifted up correspond to the front and rear positions in terms of the moving direction of the developer. The amount of the developer also increases as the developer approaches the convey-up side. Different pressures, therefore, act on the ends of the developing sleeve 44. The amounts of the developer to flow into the magnetic seal members 47 arranged on the respective ends of the developing sleeve 44 are different. Sealing under an identical condition can thus fail to sufficiently seal the developer at the end of the developing sleeve 44 on the convey-up side and cause the leakage of the developer. To prevent the leakage of the developer, the magnetic flux densities of the magnetic seal members 47 at both ends may be increased under the same condition. In such a case, the toner can coagulate on an image and/or leak on the convey-down side. Some of the developer bound by the magnetic seal members 47 at the ends of the developing sleeve 44 is replaced because of the rotation of the developing sleeve 44 and the developer conveyance force of the first conveyance screw 42. The more the developer flows in, the faster the replacement is and the less likely an immobile layer is to occur. Toner coagulation is thus more likely to occur on the developer convey-down side than on the developer convey-up side.

A replenishment port 49 is formed above the opening 41*d* on the convey-down side to secure a sufficient distance before the replenished toner is supplied to the developing sleeve 44. The toner replenished from the replenishment port 49 passes through the developing chamber 41*a* to reach the agitation chamber 41*b*. In the function-separated vertical agitation developing device used in the present exemplary embodiment, the amount of the developer increases as the developer approaches the convey-up side as described above. This means a smaller amount of developer on the convey-down side, and the opportunities for the toner to be mixed with the carrier are smaller than in the first exemplary embodiment. Such a phenomenon has been found to facilitate a toner leakage at the end of the developing sleeve 44 on the convey-down side.

A plurality of developing devices 4 according to the third exemplary embodiment were prepared for an experiment. Like the first exemplary embodiment, the magnetic seal members 47 at the ends of the developing sleeve 44 were arranged along the developing sleeve 44 in a non-contact state at a distance of approximately 1 mm. The magnetic seal members 47 arranged on both ends had different magnetic flux densities. The ratio by weight of the toner to the developer (T/D) was set to 8%. With the image ratio and other conditions being equal, image formation was repeated on 1000000 sheets of A4 paper before the developing devices 4 were compared for the leakage of the developer, the occurrence of coagulation, and the leakage of the toner. Table 3 shows the evaluation results.

TABLE 3

| Magnetic Flux | Developer Convey-down side | | Developer Convey-up side | |
|---|---|---|---|---|
| Density of Magnetic Seal Member | Leakage of Toner | Leakage of Developer | Leakage of Toner | Leakage of Developer |
| 30 mT | OK | OK | OK | NG |
| 35 mT | OK | OK | OK | NG |
| 40 mT | OK | OK | OK | NG |
| 45 mT | NG | OK | OK | NG |
| 50 mT | NG | OK | OK | OK |
| 55 mT | NG | OK | OK | OK |
| 60 mT | NG | OK | OK | OK |

As can be seen from Table 3, if the magnetic seal member 47 on the developer convey-down side was set to a magnetic flux density of 45 mT (millitesla) or more, the occurrence of toner coagulation and the leakage of the toner were observed because of too high a binding force on the developer. On the other hand, if the magnetic seal member 47 on the developer convey-up side was set to 45 mT or less, the leakage of the developer was found to occur due to insufficient sealing of the developer.

In the third exemplary embodiment, different magnetic seal members 47 are arranged on the respective ends of the developing sleeve 44. The magnetic seal member 47 on the convey-up side where the developer in the developing device 4 is conveyed upward in the direction of gravity is configured to form a greater magnetic flux density on the surface of the developing sleeve 44 than the magnetic seal member 47 on the convey-down side where the developer in the developing device 4 is conveyed downward in the direction of gravity does. Specifically, the magnetic flux density of the magnetic seal member 47 on the developer convey-down side is set to 30 mT. The magnetic flux density of the magnetic seal member 47 on the developer convey-up side is set to 60 mT. Such a configuration can prevent the leakage of the developer, the occurrence of toner coagulation, and the leakage of the toner.

As has been described above, the function-separated vertical agitation developing device including the developer agitation and conveyance devices arranged one above the other is configured so that the magnetic seal member 47 at the end of the developing sleeve 44 on the convey-up side forms a greater magnetic flux density on the sleeve surface than the magnetic seal member 47 on the convey-down side does. Such a configuration can provide a developing device 4 that prevents the leakage of the developer and causes no toner coagulation or toner leakage.

The material of the photosensitive drums 4 used in the image forming apparatus according to the third exemplary embodiment, the developer, and the configuration of the image forming apparatus are not limited to the foregoing. An exemplary embodiment of the present invention is applicable to various types of developers and image forming apparatuses. Specifically, the colors and the number of colors of the toners, the presence or absence of wax, the order of development of the color toners, and the number of developer agitation and conveyance members are not limited to the present exemplary embodiment. More specifically, an exemplary embodiment of the present disclosure is applicable even if the developer sealability is modified by means of the distances between the developing sleeve 44 and the magnetic seal members 47 as described in the second exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-251594 filed Nov. 17, 2011, which is hereby incorporated by reference herein in its entirety.

What is claimed is:

1. A developing device comprising:

a developer bearing member configured to bear a developer including toner and a magnetic carrier and to develop an electrostatic image formed on an image bearing member;

a developing container including a developing chamber and an agitation chamber, the developing chamber being configured to store the developer to be supplied to the developer bearing member in a position where the developing chamber faces the developer bearing member and to collect the developer supplied to the developer bearing member in the position where the developing chamber faces the developer bearing member, the agitation chamber being configured to communicate with the developing chamber at both ends thereof to form a circulation path to agitate the developer;

a conveyance member arranged in the developing chamber and configured to convey the developer;

a first magnet member arranged in the developing container on a side of one end of the developer bearing member on a downstream side in a developer conveyance direction of the developing chamber, opposite the developer bearing member along a circumferential direction of the developer bearing member, and configured to magnetically seal the one end of the developer bearing member; and a second magnet member arranged in the developing container on a side of the other end of the developer bearing member on an upstream side in the developer conveyance direction of the developing chamber, opposite the developer bearing member along the circumferential direction of the developer bearing member, and configured to magnetically seal the other end of the developer bearing member such that a magnetic flux density formed by the second magnet member on a surface of the developer bearing member is less than a magnetic flux density formed by the first magnet member.

2. The developing device according to claim 1, wherein a distance between the developer bearing member and the first magnet member is less than a distance between the developer bearing member and the second magnet member.

3. The developing device according to claim 1, wherein the first magnet member has a magnetic force greater than that of the second magnet member.

4. The developing device according to claim 1, wherein the developing chamber and the agitation chamber are juxtaposed to each other in a horizontal relationship.

5. A developing device comprising:

a developer bearing member configured to bear a developer including toner and a magnetic carrier and to develop an electrostatic image formed on an image bearing member;

a developing container including a developing chamber and an agitation chamber, the developing chamber being configured to supply the developer to the developer bearing member in a position where the developing chamber faces the developer bearing member, the agitation chamber being configured to communicate with the developing chamber at both ends thereof and to collect the developer supplied to the developer bearing member in a position where the agitation chamber faces the developer bearing member, the developing chamber and the agitation chamber being arranged at respective different heights;

a conveyance member arranged in the developing container and configured to circulate and convey the developer;

a first magnet member arranged in the developing container on a side of one end of the developer bearing member on a side of a communication portion between the developing chamber and the agitation chamber where the developer is conveyed upward in a direction of gravity, opposite the developer bearing member along a circumferential direction of the developer bearing member, and configured to magnetically seal the one end of the developer bearing member; and a second magnet member arranged in the developing chamber on a side of the other end of the developer bearing member on a side of a communication portion between the developing chamber and the agitation chamber where the developer is conveyed downward in the direction of gravity, opposite the developer bearing member along the circumferential direction of the developer bearing member, and configured to magnetically seal the other end of the developer bearing member such that a magnetic flux density formed by the second magnet member on a surface of the developer bearing member is less than a magnetic flux density formed by the first magnet member.

6. The developing device according to claim 5, wherein a distance between the developer bearing member and the first magnet member is less than a distance between the developer bearing member and the second magnet member.

7. The developing device according to claim 5, wherein the first magnet member has a magnetic force greater than that of the second magnet member.

* * * * *